US008459339B2

(12) United States Patent
Liu et al.

(10) Patent No.: US 8,459,339 B2
(45) Date of Patent: Jun. 11, 2013

(54) HEAT PIPE INCLUDING A SEALING MEMBER

(75) Inventors: Yue Liu, ShenZhen (CN); Jin-Peng Liu, ShenZhen (CN); Sheng-Liang Dai, ShenZhen (CN); Sheng-Lin Wu, Tu-Cheng (TW); Yu-Liang Lo, Tu-Cheng (TW)

(73) Assignees: Furui Precise Component (Kunshan) Co., Ltd., Kunshan (CN); Foxconn Technology Co., Ltd., New Taipei (TW)

( * ) Notice: Subject to any disclaimer, the term of this patent is extended or adjusted under 35 U.S.C. 154(b) by 967 days.

(21) Appl. No.: 12/542,728

(22) Filed: Aug. 18, 2009

(65) Prior Publication Data

US 2010/0300655 A1 Dec. 2, 2010

(30) Foreign Application Priority Data

May 27, 2009 (CN) ..... 2009 1 0302679

(51) Int. Cl.
*F28D 15/00* (2006.01)

(52) U.S. Cl.
USPC ..... 165/104.21; 165/104.26

(58) Field of Classification Search
USPC ..... 165/104.21, 104.26
See application file for complete search history.

(56) References Cited

U.S. PATENT DOCUMENTS

| | | | | |
|---|---|---|---|---|
| 3,595,304 | A * | 7/1971 | McHugh | 165/104.26 |
| 3,702,408 | A * | 11/1972 | Longsderff et al. | 165/104.26 |
| 3,762,011 | A * | 10/1973 | Staudhammer et al. | 165/104.26 |
| 4,015,659 | A * | 4/1977 | Schladitz | 165/104.26 |
| 4,046,190 | A * | 9/1977 | Marcus et al. | 165/104.26 |
| 5,771,967 | A * | 6/1998 | Hyman | 165/104.26 |
| 6,065,529 | A * | 5/2000 | Antoniuk et al. | 165/104.26 |
| 6,070,656 | A * | 6/2000 | Dickey | 165/104.26 |
| 6,460,612 | B1 * | 10/2002 | Sehmbey et al. | 165/104.26 |
| 6,523,259 | B1 * | 2/2003 | Pinneo | 165/104.26 |
| 6,889,755 | B2 * | 5/2005 | Zuo et al. | 165/104.26 |
| 7,069,978 | B2 * | 7/2006 | Rosenfeld et al. | 165/104.21 |
| 7,213,637 | B2 * | 5/2007 | Lin et al. | 165/104.26 |
| 7,303,001 | B2 * | 12/2007 | Leu et al. | 165/104.26 |
| 7,431,071 | B2 * | 10/2008 | Wenger | 165/104.26 |
| 7,527,762 | B2 * | 5/2009 | Hou et al. | 165/104.26 |
| 7,543,629 | B2 * | 6/2009 | Chin et al. | 165/104.21 |
| 7,694,726 | B2 * | 4/2010 | Chen | 165/104.26 |
| 7,701,716 | B2 * | 4/2010 | Blanco et al. | 165/104.26 |
| 7,743,502 | B2 * | 6/2010 | Rosenfeld et al. | 165/104.26 |
| 7,857,037 | B2 * | 12/2010 | Parish et al. | 165/104.26 |
| 7,874,347 | B2 * | 1/2011 | Chen | 165/104.26 |
| 8,286,694 | B2 * | 10/2012 | Rosenfeld et al. | 165/104.21 |

FOREIGN PATENT DOCUMENTS

JP 1-285791 A 11/1989

* cited by examiner

*Primary Examiner* — Ljiljana Ciric
(74) *Attorney, Agent, or Firm* — Altis Law Group, Inc.

(57) ABSTRACT

A heat pipe includes a tube body and a sealing member. The tube body is made of titanium and has a sealed end and an open end at two opposite ends of the tube body. The sealing member is attached to the open end and seals the open end of the tube body. The sealing member is made of a material selected from one of copper, aluminum, stainless steel, low-carbon steel, iron, nickel, tungsten, tantalum, molybdenum, rhenium and columbium. The sealing member seals the open end.

10 Claims, 2 Drawing Sheets

HEAT PIPE INCLUDING A SEALING MEMBER

BACKGROUND

1. Technical Field

The present invention relates generally to a heat pipe, and particularly to a heat pipe which has a pipe body made of titanium and a sealed end made of a ductile metal.

2. Description of Related Art

Heat pipes have excellent heat transfer performance due to their low thermal resistance, and are therefore an effective means for transfer or dissipation of heat from heat sources. Currently, heat pipes are widely used for removing heat from heat-generating components such as central processing units (CPUs) of computers. A heat pipe is usually a vacuum casing containing therein a working medium, which is employed to carry, under phase transitions between liquid state and vapor state, thermal energy from one section of the heat pipe (typically referring to as the "evaporator section") to another section thereof (typically referring to as the "condenser section").

Presently, titanium is preferred for use as a material to make heat pipes rather than copper due to its light weight, high strength and high resistance to corrosion. However, titanium has a greater rigidity than copper, whereby cracks would be incurred on a sealed end of the titanium heat pipe when an open end of the heat pipe is crimped to form the sealed end. Thus, a vacuum degree of the heat pipe would be gradually decreased due to the cracks of the heat pipe.

Therefore, it is desirable to provide a heat pipe which can overcome the above described shortcoming.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION

Figure 1:
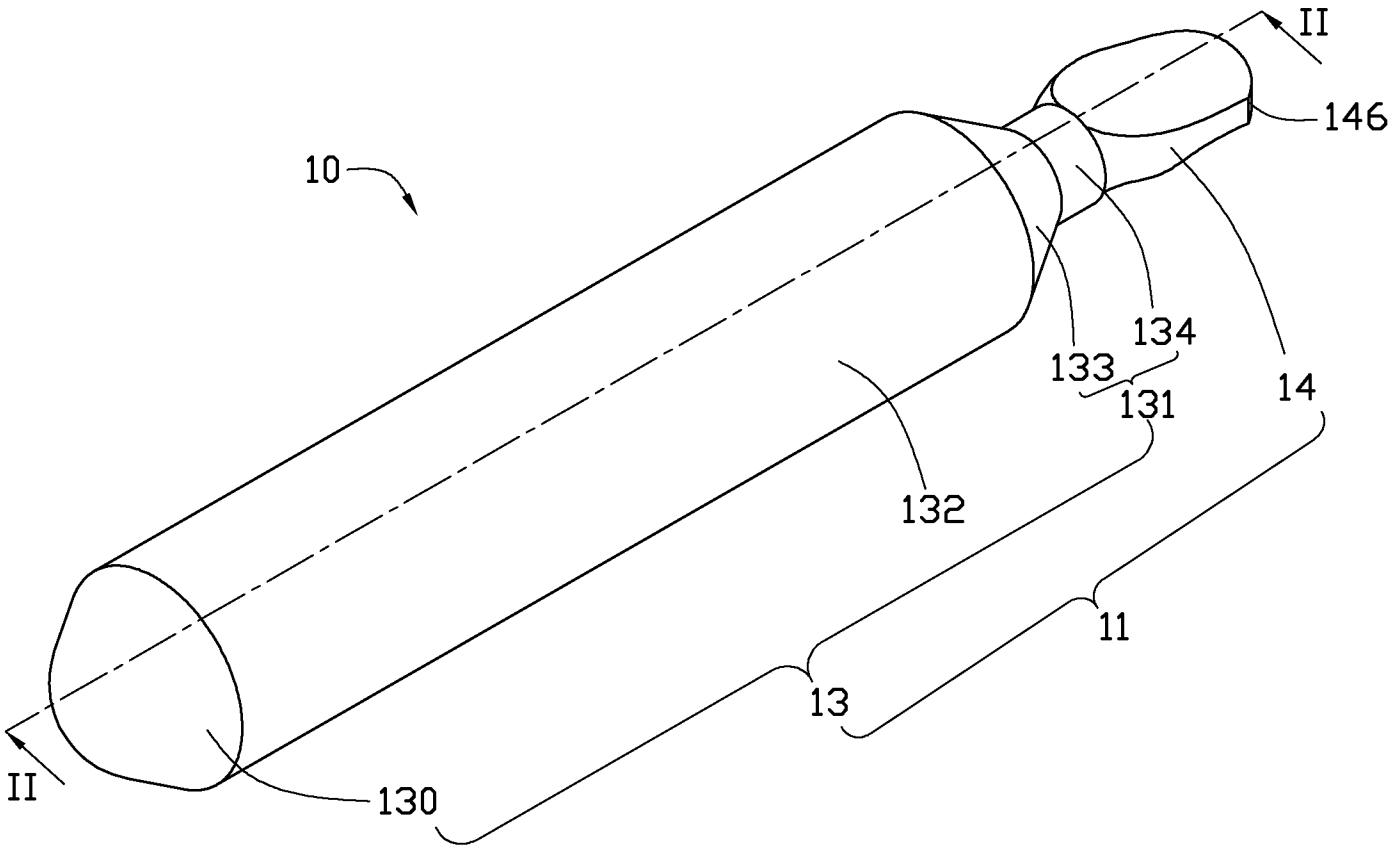
FIG. 1 is an isometric view of a heat pipe in accordance with an exemplary embodiment of the present invention.
Figure 2:
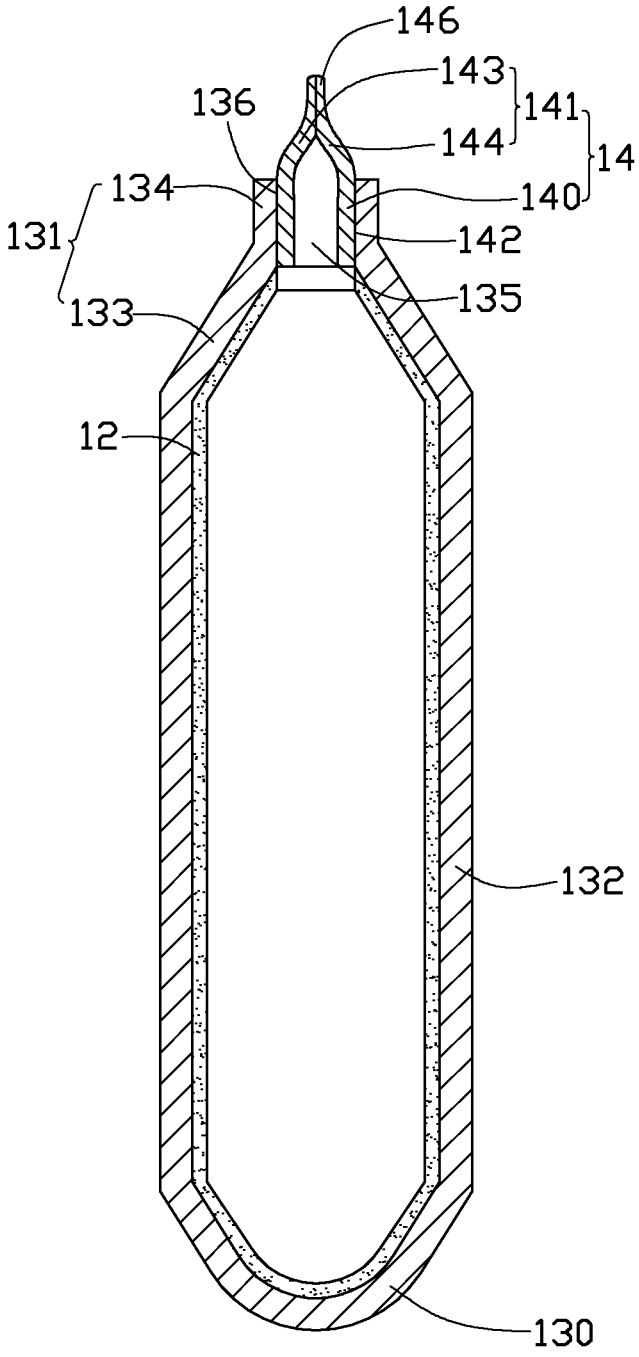
FIG. 2 is a longitudinally cross-sectional view of the heat pipe of FIG. 1, taken along line II-II thereof.

Referring to FIGS. 1-2, a heat pipe 10 includes a sealed casing 11 containing a working fluid (not shown) therein and a wick structure 12 disposed on an inner surface of the casing 11.

The casing 11 includes an elongated tube body 13 and a sealing member 14 attached to the tube body 13. The tube body 13 is made of titanium. The tube body 13 has a sealed end 130, an open end 131 opposite to the sealed end 130 of the tube body 13, and a middle main portion 132 between the sealed end 130 and the open end 131. The open end 131 includes a shrinkage portion 133 connecting with the middle main portion 132 of the tube body 13 and a connecting portion 134 connecting with the shrinkage portion 133. The shrinkage portion 133 has a tapered configuration and an outer diameter of the shrinkage portion 133 gradually decreases along an axial direction from the sealed end 130 of the tube body 13 toward the open end 131 of the tube body 13. The connecting portion 134 has a tube-shaped configuration and extends longitudinally outwardly from the shrinkage portion 133. The connecting portion 134 defines a receiving space 135 therein.

The sealing member 14 is made of a material with low rigidity and good ductility such as copper, aluminum, stainless steel, low-carbon steel, iron, nickel, tungsten, tantalum, molybdenum, rhenium and columbium. In the preferred embodiment, the sealing member 14 is made of copper.

The sealing member 14 is attached to the open end 131 of the tube body 13. The sealing member 14 includes a tube-shaped connecting portion 140 and a flat sealing portion 141 at two opposite ends thereof. The connecting portion 140 of the sealing member 14 is received in the receiving space 135 of the connecting portion 134 of the tube body 13. The connecting portion 140 of the sealing member 14 has an outer diameter the same as an inner diameter of the connecting portion 134 of the tube body 13. An outer circumferential surface 142 of the connecting portion 140 of the sealing member 14 is tightly attached to an inner circumferential surface 136 of the connecting portion 134 of the tube body 13. Especially, the connecting portion 140 of the sealing member 14 and the connecting portion 134 of the tube body 13 are connected together by welding. The sealing portion 141 of the sealing member 14 is crimped to form a top wall 143 and a bottom wall 144 attached to the top wall 143. An outer end 146 of the sealing portion 141 is sealed by welding.

In manufacturing the heat pipe 10, the tube body 13 is provided, with one end 130 of the tube body 13 being integrally sealed and the other end 131 being open. The open end 131 is shrunk to form the shrinkage portion 133 and the connecting portion 134. Then, the sealing member 14 is provided, with the connecting portion 140 thereof being inserted into the receiving space 135 of the connecting portion 134 of the open end 131 of the tube body 13. The connecting portion 140 of the sealing member 14 and the connecting portion 134 of the open end 131 of the tube body 13 are welded together. The sealing portion 141 of the sealing member 14 is crimped to cause the upper wall 143 and the bottom wall 144 of the sealing portion 141 to be intimately attached together. Finally, the outer end 146 of the sealing portion 141 is welded, so that the heat pipe 10 is hermetically sealed. When the sealing portion 141 of the sealing member 14 is crimped, the sealing portion 141 is prevented from cracking since the sealing member 14 is made of a material having a low rigidity and good ductility in comparison with titanium. Thus, the titanium-based tube body 13 avoids developing cracks during crimping of the open end thereof when the heat pipe 10 is sealed. It is well known by those skilled in the art, before the crimping of the sealing portion 141, the working fluid is injected into the tube body 13 and the air in the tube body 13 is vacuumed via the sealing member 14.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A heat pipe, comprising:

a tube body made of titanium; and a sealing member made of a material different from titanium, the sealing member having a longitudinal shape, one end of the sealing member being connected to the tube body, and the other end of the sealing member being crimped and sealed.

2. The heat pipe as claimed in claim 1, wherein the sealing member is made of a material selected from the group consisting of copper, aluminum, stainless steel, low-carbon steel, iron, nickel, tungsten, tantalum, molybdenum, rhenium and columbium.

3. The heat pipe as claimed in claim 2, wherein one end of the tube body is integrally sealed, the other end of the tube body is an open end, and the sealing member is connected to the open end of the tube body.

4. The heat pipe as claimed in claim 3, wherein the open end comprises a shrinkage portion connecting with the tube body and a connecting portion connecting with the shrinkage portion, the sealing member comprises a connecting portion and a sealing portion, the connecting portion of the sealing member is connected with the connecting portion of the open end of the tube body, and the sealing portion of the sealing member is cramped and sealed.

5. The heat pipe as claimed in claim 4, wherein the connecting portion of the sealing member is received in the connecting portion of the open end of the tube body, and an outer circumferential surface of the connecting portion of the sealing member is attached to an inner circumferential surface of the connecting portion of the open end of the tube body.

6. The heat pipe as claimed in claim 1, wherein the sealing member is made of a metal which has a ductility better than that of titanium.

7. The heat pipe as claimed in claim 6, wherein the sealing member is made of copper.

8. The heat pipe as claimed in claim 7, wherein one end of the tube body is integrally sealed, the other end of the tube body is an open end, and the sealing member is connected to the open end of the tube body.

9. The heat pipe as claimed in claim 8, wherein the open end comprises a shrinkage portion connecting with the tube body and a connecting portion connecting with the shrinkage portion, the sealing member comprises a connecting portion and a sealing portion, the connecting portion of the sealing member is connected with the connecting portion of the open end of the tube body, and the sealing portion of the sealing member is crimped and sealed.

10. The heat pipe as claimed in claim 9, wherein the connecting portion of the sealing member is received in the connecting portion of the open end of the tube body, and an outer circumferential surface of the connecting portion of the sealing member is attached to an inner circumferential surface of the connecting portion of the open end of the tube body.

* * * * *